US006279488B1

(12) United States Patent
Hachmann et al.

(10) Patent No.: US 6,279,488 B1
(45) Date of Patent: Aug. 28, 2001

(54) RAILWAY VEHICLE WITH COUPLING ELEMENT UNITS BETWEEN CAR BODY AND UNDERCARRIAGE

(75) Inventors: Ulrich Hachmann, Pyrbaum; Thomas Benker, Pegnitz; Uwe Schüller, Nürnberg, all of (DE)

(73) Assignee: DaimlerChrysler Rail Systems GmbH (DE)

( * ) Notice: Subject to any disclaimer, the term of this patent is extended or adjusted under 35 U.S.C. 154(b) by 0 days.

(21) Appl. No.: 09/402,944

(22) PCT Filed: Nov. 24, 1998

(86) PCT No.: PCT/EP98/07583

§ 371 Date: Oct. 12, 1999

§ 102(e) Date: Oct. 12, 1999

(87) PCT Pub. No.: WO99/41126

PCT Pub. Date: Aug. 19, 1999

(30) Foreign Application Priority Data

Feb. 13, 1998 (DE) ..... 198 05 895

(51) Int. Cl.[7] ..... B61F 1/00
(52) U.S. Cl. ..... 105/453; 105/199.1
(58) Field of Search ..... 105/199.1, 199.2, 105/199.3, 453

(56) References Cited

U.S. PATENT DOCUMENTS

| | | | | |
|---|---|---|---|---|
| 3,212,460 | | 10/1965 | Peras | 105/453 |
| 3,957,318 | * | 5/1976 | Wiebe | 105/199 |
| 4,955,293 | * | 9/1990 | Kramer et al. | 105/199 |
| 5,682,822 | * | 11/1997 | Sunderman et al. | 105/199.3 |
| 5,960,719 | * | 10/1999 | Sunderman et al. | 105/199.3 |

FOREIGN PATENT DOCUMENTS

| | | | |
|---|---|---|---|
| 1063196 | 8/1959 | (DE) | B61F/3/03 |
| 9304837 | 5/1993 | (DE) | B61F/5/02 |
| 4243886 | 6/1994 | (DE) | B61F/5/02 |

* cited by examiner

*Primary Examiner*—S. Joseph Morano
*Assistant Examiner*—Robert J. McCarry, Jr.
(74) *Attorney, Agent, or Firm*—Webb Ziesenheim Logsdon Orkin & Hanson, P.C.

(57) ABSTRACT

A coupling element unit with spring action is located between a car body and an undercarriage of a railway vehicle. To largely relieve the coupling element unit from forces that act at a right angle to the suspension direction, a sliding adapter is provided that has two sliding elements and that can be displaced with respect to one another parallel to a floor of the car body.

18 Claims, 2 Drawing Sheets

RAILWAY VEHICLE WITH COUPLING ELEMENT UNITS BETWEEN CAR BODY AND UNDERCARRIAGE

BACKGROUND OF THE INVENTION

1. Field of the Invention

This invention relates to railway vehicles.

2. Description of the Prior Art

On railway vehicles of the prior art, it is generally known that a car body can be elastically supported by means of coupling element units on an undercarriage frame of a truck that is located underneath the car body. In that case, the coupling elements that execute the suspension action must be connected with the car body and the undercarriage frame so that they can track the movements that occur between the car body and the undercarriage frame.

The object of the present invention is to provide a coupling element that has a spring action which is relieved of loads that are exerted at right angles to its direction of deflection.

SUMMARY OF THE INVENTION

When a railway vehicle is provided as claimed by the present invention, a sliding adapter that is integrated into the coupling element absorbs the lateral or rotational movements that occur under allowable operating conditions between the car body and the undercarriage frame. This sliding adapter can thereby be provided so that it experiences very little friction, and thus has a low likelihood of failure while requiring little or no maintenance. A non-jamming equalization of the sliding movements that occur is therefore guaranteed. The sliding adapter thereby has a degree of freedom in translation in two non-coincident axes, and is installed so that its displacement plane runs parallel to the plane that contains either the floor of the car body or the undercarriage frame. The element of the coupling unit that has the spring can be a component that needs to be moved in only one direction, as is the case with hydro-pneumatic actuators. The cylinder of this actuator can thereby be fastened to the undercarriage frame or to the floor of the car body so that it does not move, i.e. it can be bolted or welded to it, because movements at a right angle to its displacement direction are absorbed by the sliding adapter. The sliding adapter can be provided, for example, in the form of a ball-mounted platform, to keep the friction between the adapter elements low, and thus to minimize the load on the spring element at a right angle to its direction of deflection. So that running vibrations of the truck are not transmitted undamped via the coupling element units to the car body, at least one of the adapter elements of the sliding adapter that can move with respect to one another are provided with acoustical insulation means. For this purpose, this adapter element can have two plates that are connected with one another only by means of an insulation layer. This insulation layer lies parallel to the plane of displacement of the sliding adapter, and can be provided in the form of a solid disc, in the form of a plurality of discs that are located next to one another, or in particular in the form of an annular disc. To be able to absorb the forces generated by the friction of the sliding adapter without the risk of a displacement between these plates, the insulation layer is held in position by means of its end surfaces facing these plates in corresponding matching locator depressions in these plates.

The sliding adapters that are associated with a railway car can not only compensate for the transverse movements within the coupling element units that act as vertical supports during the travel of the railway vehicle, but they could also be used, for example, to move the car body closer to the edge of the platform when the car stops at a platform, in the sense of reducing the size of the gap between the car body and the edge of the platform. It may also be appropriate to provide an optionally controllable interlock device between the adapter elements to reduce their unrestricted mobility as a function of the operating conditions or to eliminate their mobility altogether.

There are also separate force coupling elements to transmit the force between the car body and the truck. For example, longitudinal forces as well as transverse forces are transmitted by means of a bearing neck that is fastened to the car body to a matching thrust bearing on the truck frame. For the transmission of longitudinal forces, however, there can also be a coupling rod that is provided in the form of a longitudinal force coupling element. Transverse forces, on the other hand, can be absorbed by means of at least one transverse force coupling element that can also be provided in the form of an actively controllable actuator, by means of which the transverse displacement between the car body and the running carriage can be controlled as a function of the operating requirements. The displacement movements between the car bodies and the running carriage caused by the force coupling elements are thereby smaller than the allowable displacement movement of the respective sliding adapter.

The spring element inserted into the respective coupling element unit can be passive, and can be provided, for example, in the form of steel coil springs or solid rubber springs. Preferably, however, the spring element can be actively controlled, and can be provided in particular in the form of a hydro-pneumatically controlled hydraulic cylinder, the length of which can be changed only in one direction. To also be able to equalize the tipping movements between the car body and the truck frame that result from distortions or from the inclination of the car body or of the tracks, the coupling element unit can be equipped with a knuckle joint that is provided in the manner of a ball-and-socket joint. This knuckle joint is preferably installed between the spring element and the sliding adapter and has only one knuckle.

The invention is explained in greater detail below with reference to the exemplary embodiment illustrated in the accompanying drawings.

DETAILED DESCRIPTION OF THE PREFERRED EMBODIMENTS

Figure 1:
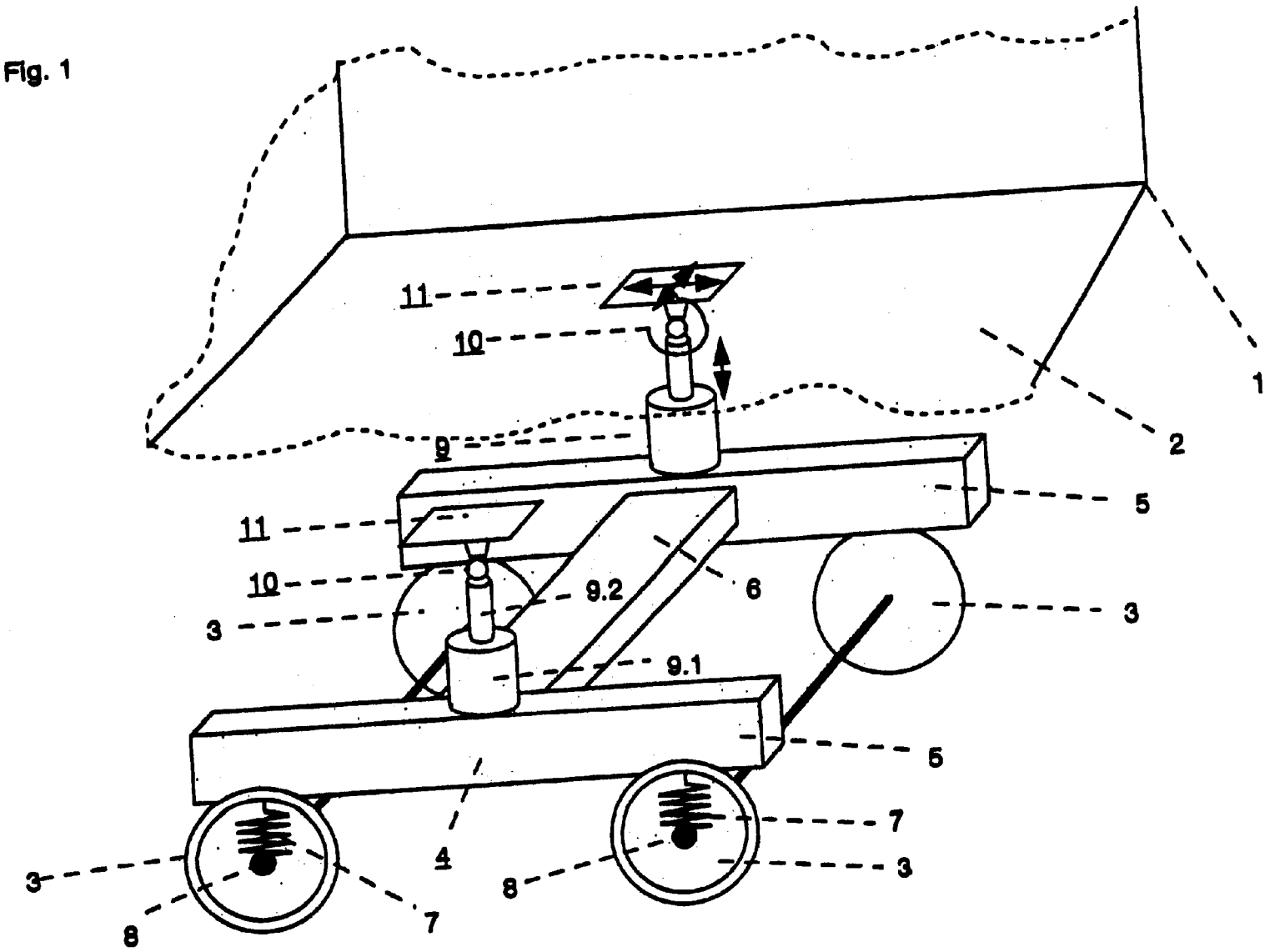
FIG. 1 shows part of a railway vehicle with sliding adapters, in the vicinity of a truck.
Figure 2:
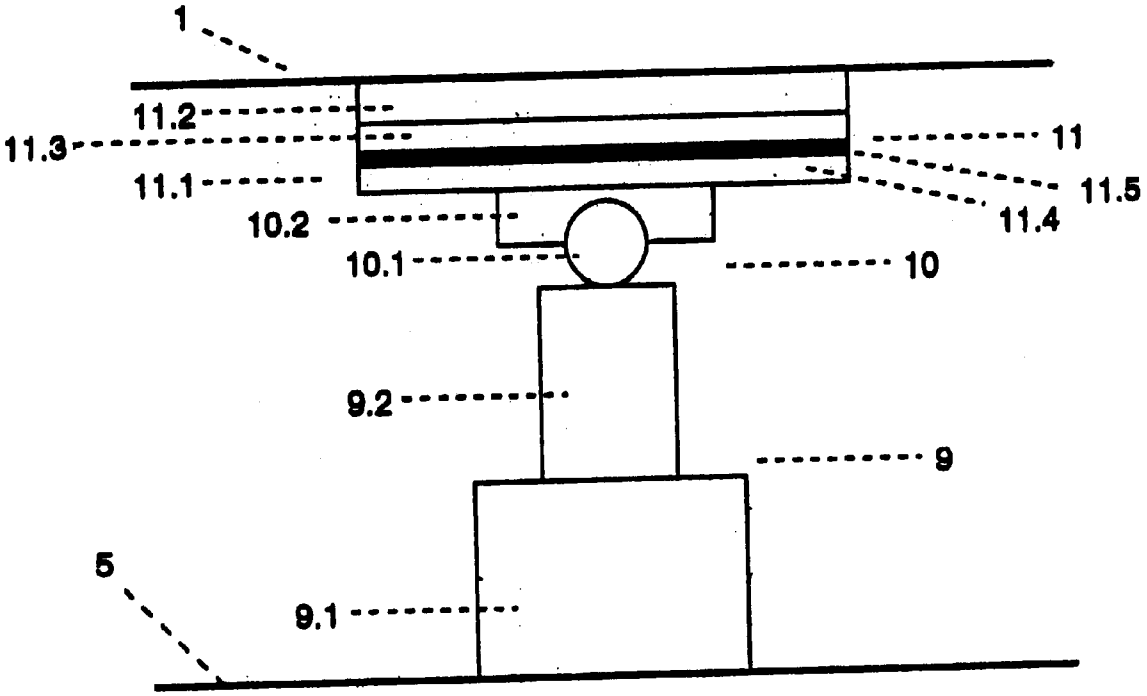
FIG. 2 shows a side view of the system illustrated in FIG. 1, in the vicinity of a coupling element unit with a sliding adapter.
Figure 3:
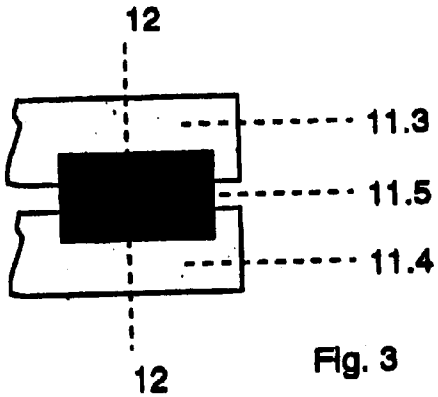
FIG. 3 is a detail of the sliding adapter in cross section.

FIG. 1 shows a schematic illustration of a vehicle, in particular or a railway vehicle, and a car body 1, underneath the floor wall 2 of which there is at least one truck. The truck has at least one axle and two wheels 3, and in this case two axles or four wheels 3. The wheels 3 are provided in the form of railroad car wheels. An undercarriage frame 4 is thereby supported with longitudinal beams 5 that run in the direction of travel of the truck, which beams 5 are connected to each other by means of at least one cross member 6, are supported by means of primary springs 7 on wheel bearing elements 8 of the wheels 3, and thus couple the wheels 3 together so that they run smoothly. Approximately in the middle of two wheels 3 that are one behind the other in the direction of travel, on each longitudinal beam 5 perpendicular to the plane formed by these longitudinal beams 5, there is a coupling element unit, by means of which the car body 1 is supported with its floor wall 2 on the truck.

The coupling element unit consists of an actuator 9 that acts as a spring element, a knuckle joint connector 10 that can be tilted in all directions and a conducting connector 11 that is located mechanically in series in the direction of action of the actuator 9. The actuators 9, which can be provided in the form of hydro-pneumatcally controlled hydraulic cylinders, have two actuator elements 9.1 and 9.2 that can be adjusted axially only in a straight line with respect to one another. The knuckle joint 10 can be provided in the form of a universal or ball-and-socket joint, in the form of an elastomer joint or in the manner of a spring steel bar, so that it can execute pivoting movements with a restricted amount of movement in all directions. The sliding connector 11 has degrees of freedom in translation only in a plane that lies parallel to the floor wall 2 of the car body 1. The displacement capability in a plane of this sliding connector, which is not directionally restricted, is thereby limited to specified values. As a result of the association between the individual components 9, 10, 11 of the connecting device, only the actuator can compensate for differences in the distance between the truck 4 and the car body 1, the knuckle joint 10 can compensate only for non-directionally dependent tipping movements, and the sliding connector 11 can compensate only for movements that are directed at right angles to the actuation direction or to its actuation axis 12. In this regard, it is basically unimportant in what sequence the components 9, 10, 11 are connected to one another, as long as the two components on the ends are fastened on one hand to the truck 4 and on the other hand to the car body 1.

In the exemplary embodiment depicted in the illustration, the cylinder housing 9.1 is fastened rigidly on one of the longitudinal beams 5, for example by means of hydro-pneumatic actuators 9, with a perpendicularly oriented actuator axis 12. The other actuator element 9.2 of the actuator 9 is a tappet rod of the cylinder piston that is guided so that it can be displaced in a straight line only along the actuation axis 12, whereby the free end of this actuator element 9.2 is rigidly connected with the first pivoting element 10.1 of the pivoting connector 10, while the second pivoting element 10.2 is rigidly connected with the primary sliding element 11.1 of the sliding element 11. The knuckle joint 10 that is provided in the form of a ball-and-socket joint allows only tipping movements that occur between the planes formed by the longitudinal beams 5 and the floor wall 2. To also be able to compensate for lateral movements between the vehicle parts 1, 3, 4 or the lateral adjustment that results from a distortion of the planes, there is a sliding connector 11, the primary sliding element 11.1 of which is firmly connected with the second pivoting element 10.2 of the knuckle joint 10, and the secondary sliding element 11.2 of which is firmly connected with the floor wall 2 of the car body 1.

At least one sliding element 11.1 consists of two plates 11.3 and 11.4 lying parallel to each other and made of an inherently rigid material, in particular metal, and between which there is an insulation layer 11.5. The plates 11.3 and 11.4 are firmly connected to one another by means of the insulation layer which is made of elastic, vibration-damping material. The insulation layer 11.5 thus lies parallel to the displacement plane of the sliding adapter 11. Preferably, the insulation layer 11.5 is provided in the shape of a ring which is oriented equi-axially with the adjustment axis of the actuator 9 and the knuckle joint 10. To secure the insulation layer 11.5 against radial displacement, locator depressions 12 are worked into the two plates 11.3 and 11.4, the depth of which depressions in the axial direction is significantly less than the thickness of the insulating layer 11.5. Because there is security against radial displacement, a lateral movement of the sliding adapter 11 occurs only between the sliding elements 11.1 and 11.2.

In this construction, the actuator 9 can replace flexible elements that act as a secondary suspension. For this purpose, the actuator 9 can be provided in the form of a hydro-pneumatic operating cylinder, and thus can not only allow a vertical equalization between the car body and the truck frame, but can also have spring characteristics like those possessed otherwise by coil springs, air springs or similar springs. The spring characteristic can thereby be controlled as a function of the specific requirements. The force coupling between the car body and the truck for the support of longitudinal and transverse forces can conventionally be provided, for example, by means of control arms, truck center pins or figure-eight coupling elements or elastic buffer or spring elements.

The connecting device 9, 10, 11 can of course also be installed cambered between the car body 1 and the truck 4. In that case, the sliding connector 11 can be also be installed without any adverse effect on function and safety, between the respective longitudinal beam 5 and the facing actuator element 9.1 of the actuator 9. In that case, the secondary joint element 10.2 is firmly connected with the car body 1. Without any change in function, the sliding connector 11 can of course also be installed between the actuator 9 and the knuckle joint 10. In all the variant embodiments, and under all operating conditions, the actuator 9 retains its perpendicular position with respect to the truck 4 to the extent that it is connected with it directly on the longitudinal beams 5 or by means of the sliding connector 11. If the actuator 9 sits directly on the car body 1, of via the sliding connector 11, it retains its perpendicular position under all operating conditions with respect to the plane thereby defined.

The sliding adapter applied as claimed by the invention requires a hydro-pneumatic secondary spring, so that in spite of the actuator which stands perpendicular on the truck frame and can move in only one axis vertically, and a knuckle between the piston rod of the actuator and the sliding adapter, the mobility of the car body with respect to the truck in a plane parallel to the floor of the car body, which is necessary for operation and safety, is guaranteed. Also, with the sliding adapter, as a result of the arrangement of additional parts located in the direction of transmission, the transmission of vibrations from the undercarriage into the car body structure is minimized. For this purpose, the insulating layer is provided with vibration-isolating characteristics that transmit the forces applied in the vertical direction in full, as well as the horizontal forces that are necessary to overcome the friction of the sliding elements.

Alternatively, instead of with sliding elements, the sliding adapter can be provided with roller elements, in the manner of a ball-mounted platform.

Additional advantages of the invention are the fact that the sliding adapter makes possible a fixed clamped position of the vertical actuator, and the car body is thereby mounted at all times so that it is stable against tipping, but also is free to move in the plane of the car body, which is necessary to allow transverse play and travel around curves. The transverse ride comfort can thereby be optimized by a suitable selection and configuration, in particular of the frictional components of the sliding elements.

What is claimed is:

1. A railway vehicle, comprising an undercarriage and, located above it, a car body that is supported vertically by means of at least one pair of coupling element units with a spring action of an undercarriage frame of the undercarriage, wherein the coupling element unit has a sliding adapter with two sliding elements, wherein one of the sliding elements can be displaced freely in a plane that lies parallel to the floor of the car body over limited distances with respect to the other sliding element, wherein at least one of the sliding elements has two plates that are connected to one another by means of an insulating layer that lies parallel to the plane of displacement of the sliding adapter, wherein the insulating layer is a ring, and wherein on the plates there are suitable locator depressions in which the insulating layer is engaged.

2. The railway vehicle as claimed in claim 1, wherein the sliding adapter is a ball-mounted platform.

3. The railway vehicle as claimed in claim 2, wherein at least one of the sliding elements has two plates that are connected to one another by means of an insulating layer that lies parallel to the plane of displacement of the sliding adapter.

4. The railway vehicle as claimed in claim 2, wherein at least one of the sliding elements is firmly connected with at least one of the car body and the undercarriage frame.

5. The railway vehicle as claimed in claim 2, wherein at least one of the sliding elements is connected with a spring element, the spring travel of which is perpendicular to a plane of displacement of the sliding adapter.

6. The railway vehicle as claimed in claim 2, wherein located between the car body and the undercarriage is a transverse force coupling element with a controllable transverse adjustment travel.

7. The railway vehicle as claimed in claim 1, wherein at least one of the sliding elements is firmly connected with at least one of the car body and the undercarriage frame.

8. The railway vehicle as claimed in claim 1, wherein at least one of the sliding elements is connected with a spring element, the spring travel of which is perpendicular to a plane of displacement of the sliding adapter.

9. The railway vehicle as claimed in claim 8, wherein the spring element is passive.

10. The railway vehicle as claimed in claim 8, wherein the spring element is actively controlled.

11. The railway vehicle as claimed in claim 10, wherein the spring element is a hydro-pneumatically controlled hydraulic cylinder.

12. The railway vehicle as claimed in claim 8, wherein the spring element is fastened to at least one of the undercarriage frame and the car body.

13. The railway vehicle as claimed in claim 8, wherein the coupling element unit has a knuckle joint that is a ball-and-socket joint and is connected to at least one of the sliding adapter and the spring element.

14. The railway vehicle as claimed in claim 1, wherein the coupling element unit has a knuckle joint that is a ball-and-socket joint and is connected to at least one of the sliding adapter and a spring element.

15. The railway vehicle as claimed in claim 1, wherein a longitudinal force coupling element is located between the car body and the undercarriage.

16. The railway vehicle as claimed in claim 1, wherein located between the car body and the undercarriage is a transverse force coupling element with a controllable transverse adjustment travel.

17. The railway vehicle as claimed in claim 16, wherein a transverse adjustment travel of the transverse force coupling element is smaller than a free displacement travel of the sliding adapter.

18. The railway vehicle as claimed in claim 1, wherein at least one of the sliding elements is connected with a spring element, the spring travel of which is perpendicular to a plane of displacement of the sliding adapter.

* * * * *